US006698371B1

(12) United States Patent
Stoltzfus

(10) Patent No.: US 6,698,371 B1
(45) Date of Patent: Mar. 2, 2004

(54) BOAT WITH PERSONNEL ELEVATOR APPARATUS

(76) Inventor: Harold A. Stoltzfus, 563 Strasburg Rd., Paradise, PA (US) 17562

( * ) Notice: Subject to any disclaimer, the term of this patent is extended or adjusted under 35 U.S.C. 154(b) by 0 days.

(21) Appl. No.: 10/281,585

(22) Filed: Oct. 28, 2002

(51) Int. Cl.[7] ..... B63B 1/00
(52) U.S. Cl. ..... 114/61.1; 182/69.1
(58) Field of Search ..... 114/61.1, 123, 114/126; 182/69.1, 69.4, 69.5, 69.6

(56) References Cited

U.S. PATENT DOCUMENTS 3,934,531 A * 1/1976 Allen ..... 114/63
4,556,124 A 12/1985 Lotto ..... 182/63
5,167,295 A 12/1992 Moog ..... 180/209
5,829,376 A * 11/1998 Kostanski ..... 114/61.1
5,911,288 A 6/1999 Zafirakis ..... 182/150

OTHER PUBLICATIONS

Web pages: Harcon Corporation "Pontoon Boat with Work Platform" Dated Sep. 26, 2002.
News Photo by Associated Press Dated Oct. 10, 2002.

* cited by examiner

*Primary Examiner*—Jesus D. Sotelo
(74) *Attorney, Agent, or Firm*—Martin Fruitman

(57) ABSTRACT

The apparatus is a boat with a device for lifting a worker up to a location under bridges for maintenance or inspection. The preferred embodiment of the invention is an outboard motor propelled catamaran with a scissors type lift elevator or aerial boom located approximately in the center of the boat. One or more outrigger pontoons that are partially filled with water stabilize the boat, and the pontoons are pivoted back aboard the boat and emptied for over the road transport of the boat.

9 Claims, 3 Drawing Sheets

BOAT WITH PERSONNEL ELEVATOR APPARATUS

BACKGROUND OF THE INVENTION

This invention deals generally with boats and more specifically with a boat upon which is mounted an elevator device to raise personnel above the boat deck.

Most of us are vaguely aware that highway bridges must be inspected regularly, but few are aware of the procedures involved in such inspections. Since inspection of the underside of such structures is federally mandated, there must be some way to gain access to the structure below the roadway. Most bridge inspections are performed by walking on the ground, from ladders, with conventional bucket trucks, or, for bridges high above rivers, by using articulating cranes with platforms or buckets on them.

The cranes almost always require lane closures on the bridge, although occasionally a shoulder closure will suffice, and often bridges that have been load rated cannot be accessed by cranes because the cranes are too heavy. For such bridges catenary cables with sliding or rolling scaffolds are an alternative. Catenary cables do not generally require lane closures, but their installation is difficult, and often dangerous, work.

There is an alternative for bridges which are not too high above the ground level they cross. That alternative is to use an aerial boom with a bucket and to support it from a vehicle that can traverse the ground below the bridge. One such apparatus is an aerial boom mounted upon a four wheel drive truck, such as a Hummer. Such vehicles are presently being used for some bridge inspections. The limitation of such vehicles is that they can not operate in or cross rivers of any significant depth. In fact, the depth limit is determined by the height of the vehicle engine above the bottom of the wheels, and that is typically only about 2½ feet.

Some use has been made of boats for access to the underside of bridges, but they are makeshift arrangements which are time consuming to set up and limited in height. Typically, they have simply involved conventional scaffolds erected aboard a boat and extending above deck height. Operation of such boat and scaffold systems in tidal areas often requires multiple changes and adjustments in the scaffolding heights during the course of the bridge inspection. Clearly, such scaffolds must be completely disassembled before the boat is moved over a road to a new location.

It would be very beneficial to have available a variable lift device that has the capability of inspecting or maintaining different height bridges above deep water without any use of the bridge roadway itself and without time consuming set up of scaffolds. The versatility of such a unit would be enhanced even further if it could be moved over roads without being disassembled.

SUMMARY OF THE INVENTION

The present invention is an outboard motor propelled catamaran boat with a permanently attached centered elevator lift that can raise personnel as high as 32 feet above the waterline. Although the preferred embodiment of the boat itself is narrow enough to be transported over roads on a trailer, partially water-filled outrigger pontoons increase the beam to a width sufficient to stabilize the boat when the lift is fully raised. The outrigger pontoons are mounted on pivoting arms so that they can be pivoted back aboard the boat for transport, and when the outrigger pontoons are aboard and resting on their supports above the deck, they are well below the height of the lowered elevator lift. The typical road height of the boat on its trailer is therefore only 13 feet.

The preferred embodiment of the invention uses two outrigger pontoons extending off only one side of the boat. This configuration yields a valuable benefit for bridge maintenance. It permits one side of the boat to be moved close up against bridge supports, and since the personnel platform atop the elevator lift is essentially the same width as the boat, personnel can easily inspect or work on the bridge support to which they are adjacent.

The invention therefore furnishes simple access to bridges above deep water, but is easily transported to locations where bridge work is required. Furthermore, the relatively small size of the boat permits it to be launched at conventional boat ramps after which it can move under its own power to the bridge location.

DETAILED DESCRIPTION OF THE INVENTION

Figure 1:
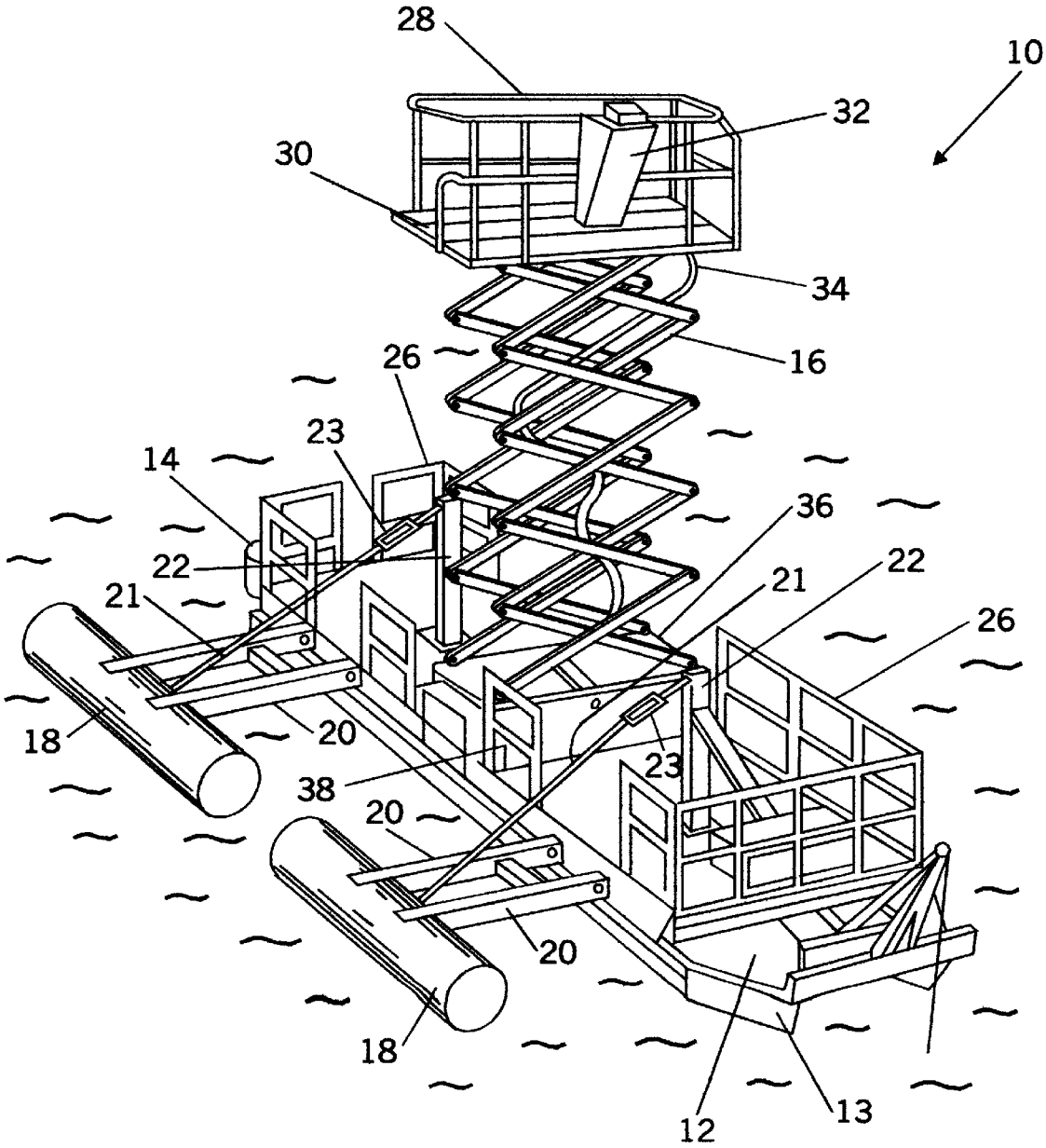
FIG. 1 is a perspective view of the preferred embodiment of the invention with the outrigger pontoons extended and the scissors elevator lift extended.

FIG. 1 shows lift boat 10 of the present invention that is catamaran boat 12 with hull 13 propelled by outboard motors 14. Boat 12 has a permanently attached scissors elevator lift 16 that can raise personnel as high as 32 feet above the water. Although the preferred embodiment of boat 12 itself is only 8 feet wide, and therefore narrow enough to be transported over roads on a trailer, partially water-filled outrigger pontoons 18 increase the beam to a 14 feet width and stabilize boat 12 when elevator lift 16 is raised. Pontoons 18 are mounted on pivoting arms 20 which are also attached to and pivot on deck 24. Pontoons 18 can therefore pivot back aboard the boat for storage and transport. However, when pontoons 18 are deployed in the water they are fixed in place by adjustable length, removable, rigid struts 21 that are attached to pontoons 18 and to fixed points on pontoon supports 22 that are attached to deck 24. When pontoons 18 are aboard boat 12 and resting on pontoon supports 22 above deck 24, they are below the 6 foot 4 inch height of lowered elevator lift 16. The typical road height of the boat on its trailer is therefore only 13 feet. Boat 12 used in the preferred embodiment is 30 feet long, and pontoons 18 are 24 inches wide at the waterline.

For safety purposes, barrier 26 is installed around deck 24, and railings 28 surround elevator platform 30. The operation of elevator lift 16 is controlled from elevator platform 30 by the use of control box 32, and control cables 34 extend down from elevator platform 30 to elevator lift base 36 which includes a battery power source (not shown). Scissors elevator lift 16 is a conventional unit Upright Model 31 N made by the Upright Company. It is built for normal use on land and usually is supported by four wheels. However, for use in this application, the wheels are removed and the axles are mounted through plates 38 that are attached to deck 24. At full elevation, elevator lift 16 places elevator platform 30 at 32 feet above water level, which yields a working inspection height of 38 feet above the water.

Figure 2:
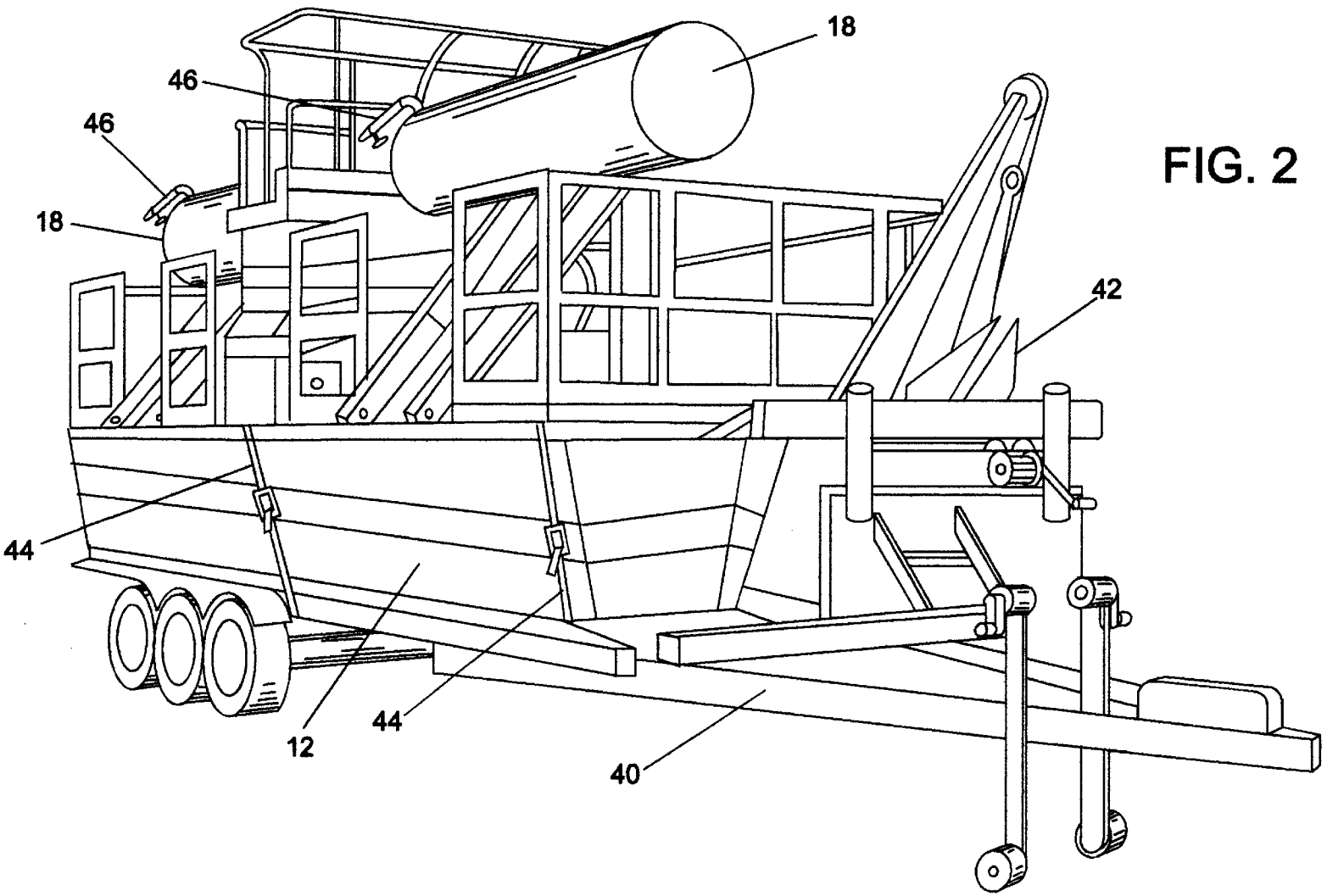
FIG. 2 is a view of the preferred embodiment of the invention loaded upon a trailer with the outrigger pontoons loaded aboard and the elevator lift lowered.

FIG. 2 is a view of boat 12 of the preferred embodiment of the invention loaded upon trailer 40 with outrigger pontoons 18 loaded aboard and scissors elevator lift 16 fully lowered. As can be appreciated from FIG. 2, with pontoons 18 stowed aboard and elevator lift 16 lowered, the clearance height of the entire structure is suitable for road travel. To facilitate this, boat anchor 42 is also stowed aboard, and boat 12 is tied down on conventional trailer 40 with conventional tie down straps 44.

Some other aspects of the invention can also be seen in FIG. 2. Valved pipes 46 are used to supply and remove water ballast from outrigger pontoons 18. Pontoons 18 are chambered so that when the pontoons are deployed in the water, the bottom chambers, which occupy about one-third the total volume, are filled with water while the balance of the volume is kept full of air for flotation. Each of the two pontoons is 2 feet in diameter and 9 feet, 4 inches long, and when they are deployed they are half submerged. The pontoons are an important factor in the stability of boat 12 when elevator lift 16 is at full height. The water is drained out as the pontoons are pivoted aboard the boat in order to reduce the trailer load. They are pivoted aboard with the aid of cables and winches (see FIG. 3). The total weight of boat 12 before mounting on trailer 40 is approximately 12,600 pounds.

Figure 3:
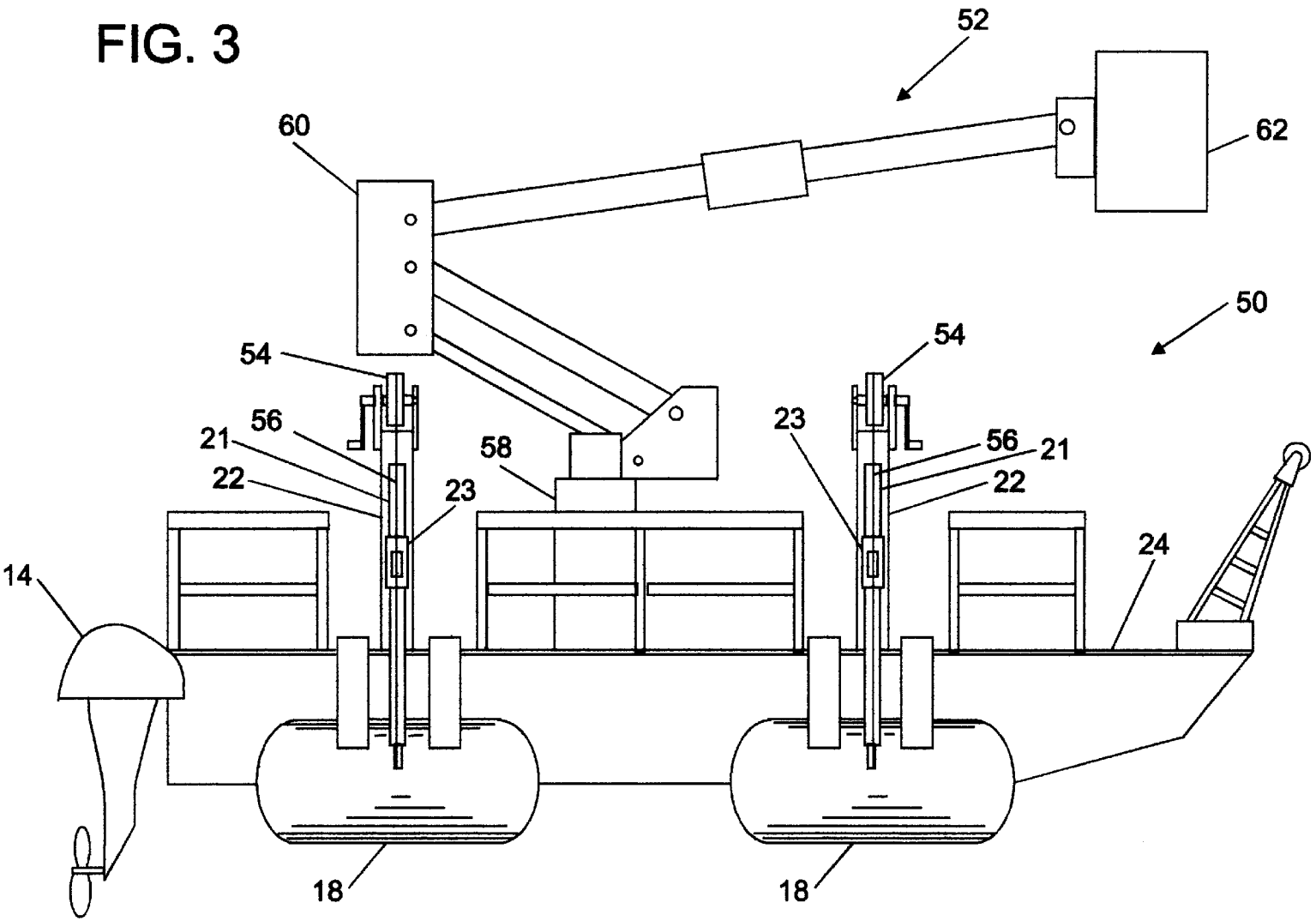
FIG. 3 is a side view of an alternate embodiment of the invention that uses an aerial boom to lift personnel into position.

FIG. 3 is a side view of an alternate embodiment of the invention in which boat 50 has aerial boom 52 installed on deck 24 to lift personnel into position for bridge maintenance.

As with the preferred embodiment shown in FIG. 1 and FIG. 2, boat 50 is propelled by outboard motors 14 and is stabilized by pontoons 18. Pontoons 18 are locked into their deployed position by adjustable length, rigid struts 21. The lengths of struts 21, are adjusted by the use of turnbuckles 23 (see FIGS. 1 and 3). These lengths are adjusted for various heights and orientations of the elevator devices.

When pontoons 18 are stowed aboard boat 50 they are held against pontoon supports 22. Winches 54 and cables 56, which are not seen in FIG. 1 or FIG. 2, are attached to pontoons 18 and are used to lift pontoons 18 aboard boat 50 for loading onto a trailer for road transport.

The significant difference between the preferred embodiment of FIGS. 1 and 2 and the alternate embodiment of FIG. 3 is the elevator device used to lift personnel into their bridge inspection and maintenance positions. In the alternate embodiment of FIG. 3 conventional aerial boom 52 is used as the elevator device.

Aerial boom 52 is mounted above deck 24 and supported by pillar 58. Aerial boom 52 is a conventional assembly and includes gears and hydraulic motors so that it can rotate 360 degrees in the horizontal plane. Conventional elbow structure 60 of aerial boom 52 permits bucket 42 to be lowered and retracted or raised and extended. The position of bucket 62 shown in FIG. 3 is an intermediate one, and bucket 62 can be raised and extended significantly more.

In the embodiment of boat 50 shown in FIG. 3, aerial boom 52 is a Versalift Model SST37EIH made by Time Manufacturing Co. of Waco, Tex. It has a bucket capacity of 400 pounds, and the bottom of bucket 42 has a maximum height (above deck 24) of 36.7 feet.

The present invention thereby provides an apparatus which fills a vital need. It can reduce the time and cost of inspecting bridges above deep water, but most important, it can permit such inspections without any effect whatsoever on the traffic over the bridge. Furthermore, with the pontoons stored aboard the boat, the personnel elevator apparatus fully lowered, and the boat loaded onto a trailer, the width and height of the combined boat and trailer are below legal road limits so that the trailer with the boat aboard can legally move over roads without special permits.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, different size boats and lift devices of different design can be used. Moreover, fewer or more pontoons installed on one or both sides of the boat can be used, and different shaped hulls and different propulsion devices are possible. Furthermore, the invention can, of course, be used for purposes other than inspection of bridges.

What is claimed as new and for which Letters Patent of the United States are desired to be secured is:

1. A boat comprising:

a hull with a deck and a propulsion device;

at least one pontoon deployable out from a side of the boat hull, with each pontoon being moveable onto a storage position aboard the boat; and a personnel elevator apparatus mounted on and attached to the boat;

wherein with the pontoons stored aboard the boat, the personnel elevator apparatus lowered, and the boat loaded onto a trailer, the width and height of the combined boat and trailer are below legal road limits so that the trailer with the boat aboard can legally move over roads without special permits.

2. The boat of claim 1 wherein the personnel elevator apparatus is a scissors elevator lift.

3. The boat of claim 1 wherein the personnel elevator apparatus is an aerial boom.

4. The boat of claim 1 wherein two pontoons are deployable from one side of the boat hull.

5. The boat of claim 1 further including a rigid strut attached to a deployed pontoon and to a fixed point above the deck of the boat.

6. The boat of claim 1 further including a removable, adjustable length, rigid strut attached to a deployed pontoon and to a fixed point above the deck of the boat.

7. The boat of claim 1 wherein each pontoon is attached to pivoting arms that have one end attached to the boat, so that the pontoons can be pivoted onto the storage position on the boat.

8. The boat of claim 1 wherein each pontoon is attached to pivoting arms that have one end attached to the boat, so that the pontoons can be pivoted onto the storage position on the boat, and a cable attached to a winch is attached to the pontoon to pull the pontoon aboard the boat.

9. The boat of claim 1 wherein each deployed pontoon is partially filled with water to better stabilize the boat.

* * * * *